US006758767B1

(12) United States Patent
Wang

(10) Patent No.: US 6,758,767 B1
(45) Date of Patent: Jul. 6, 2004

(54) EQUIPMENT FOR CROQUET

(76) Inventor: Andrew Wang, 2/F., No. 184, Fuhsing N. Rd., Taipei City (TW)

( * ) Notice: Subject to any disclaimer, the term of this patent is extended or adjusted under 35 U.S.C. 154(b) by 0 days.

(21) Appl. No.: 10/618,672

(22) Filed: Jul. 15, 2003

(51) Int. Cl.[7] ..... A63B 59/10

(52) U.S. Cl. ..... 473/410; 473/411; 473/412; 473/413; 473/558

(58) Field of Search ..... 473/410–413, 473/558, FOR 129, FOR 186

(56) References Cited

U.S. PATENT DOCUMENTS 161,080 A * 3/1875 West ..... 473/411
280,807 A * 7/1883 Farley ..... 473/410
4,531,736 A * 7/1985 Sahler ..... 473/410
5,102,131 A * 4/1992 Remington ..... 473/570
5,370,390 A * 12/1994 Swanson ..... 473/410
6,575,855 B1 * 6/2003 Buzak et al. ..... 473/569
2003/0199343 A1 * 10/2003 Ilcisin et al. ..... 473/570

* cited by examiner

*Primary Examiner*—Mark S. Graham
(74) *Attorney, Agent, or Firm*—Rosenberg, Klein & Lee

(57) ABSTRACT

Croquet equipment formed of a mallet, a ball, a hoop and a stake is disclosed in which, the mallet has two vibration switch-controlled light emitting modules detachably mounted in the two ends of the light penetrable head thereof; the ball has a vibration switch-controlled light emitting module detachably mounted in the light penetrable body thereof; the stake has a manual on/off switch-controlled light emitting module detachably mounted in the anchoring point and a light guide axially extended from the light emitting module for guiding light through the periphery of the tubular shaft thereof.

3 Claims, 7 Drawing Sheets

EQUIPMENT FOR CROQUET

BACKGROUND OF THE INVENTION

1. Field of the Invention:

The present invention relates to the game of croquet and, more specifically, to a complete set of equipment for the game of croquet.

2. Description of the Related Art:

Croquet is a game played by striking wooden balls through hoops in the ground, i.e., the equipment for the game of croquet includes at least one mallet 2 having a head 1 for striking, a ball 3, a hoop 4, and a stake 5 (see FIG. 1). When playing the game, hit the ball 3 with the head 1 of the mallet 2 to drive the bait 3 through the hoop 4 (see also FIG. 2A), or hit the ball 3 with the head 1 of the mallet 2 to move the ball 3 to the stake 5 (see FIG. 2B). This game is suitable for people of different ages. However, when playing the game in the dark, the player cannot see the moving direction of the ball.

SUMMARY OF THE INVENTION

The present invention has been accomplished under the circumstances in view. It is the main object of the present invention to provide a set of equipment for croquet, which has the mallet, the ball and the stake respectively mounted with at least one detachable light emitting module for emitting light when playing the game. It is another object of the present invention to provide a set of equipment for croquet, which has the light emitting modules reinforced with metal means against impact.

To achieve these and other objects of the present invention, the set of equipment for croquet is comprised of a mallet, a ball, a hoop, and a stake. The mallet comprises two recessed receiving holes respectively axially extended in two ends of a head thereof, two light emitting modules respectively detachably mounted in the recessed receiving holes and adapted to emit light through the mallet, and two plastic face members respectively capped on the two ends of the head to seal the respective light emitting modules in the recessed receiving holes, the plastic face members admitting light. The ball is molded from light penetrable plastics, comprising an internally threaded and radially extended receiving hole, a light emitting module detachably mounted in the internally threaded and radially extended receiving hole and adapted to emit light through the ball, and a screw cap threaded into the internally threaded and radially extended receiving hole and maintained in flush with the periphery of the ball to hold the light emitting module in the ball. The stake is comprised of a light penetrable tubular shaft, the tubular shaft having a bottom end and a top end, an anchoring point fastened to the bottom end of the tubular shaft, the anchoring point having a hollow neck fastened to the bottom end of the tubular shaft, a cap fastened to the top end of the tubular shaft, a light emitting module mounted in the hollow neck of the anchoring point, and an elongated light guide connected to the light emitting module in the hollow neck of the anchoring point and axially suspended in the tubular shaft.

DETAILED DESCRIPTION OF THE PREFERRED EMBODIMENT

Referring to FIGS. 3~7, the invention includes a mallet 10, a ball 30, a stake 50, and light emitting modules 20 respectively installed in the mallet 10, the ball 30 and the stake 50.

Figure 1:
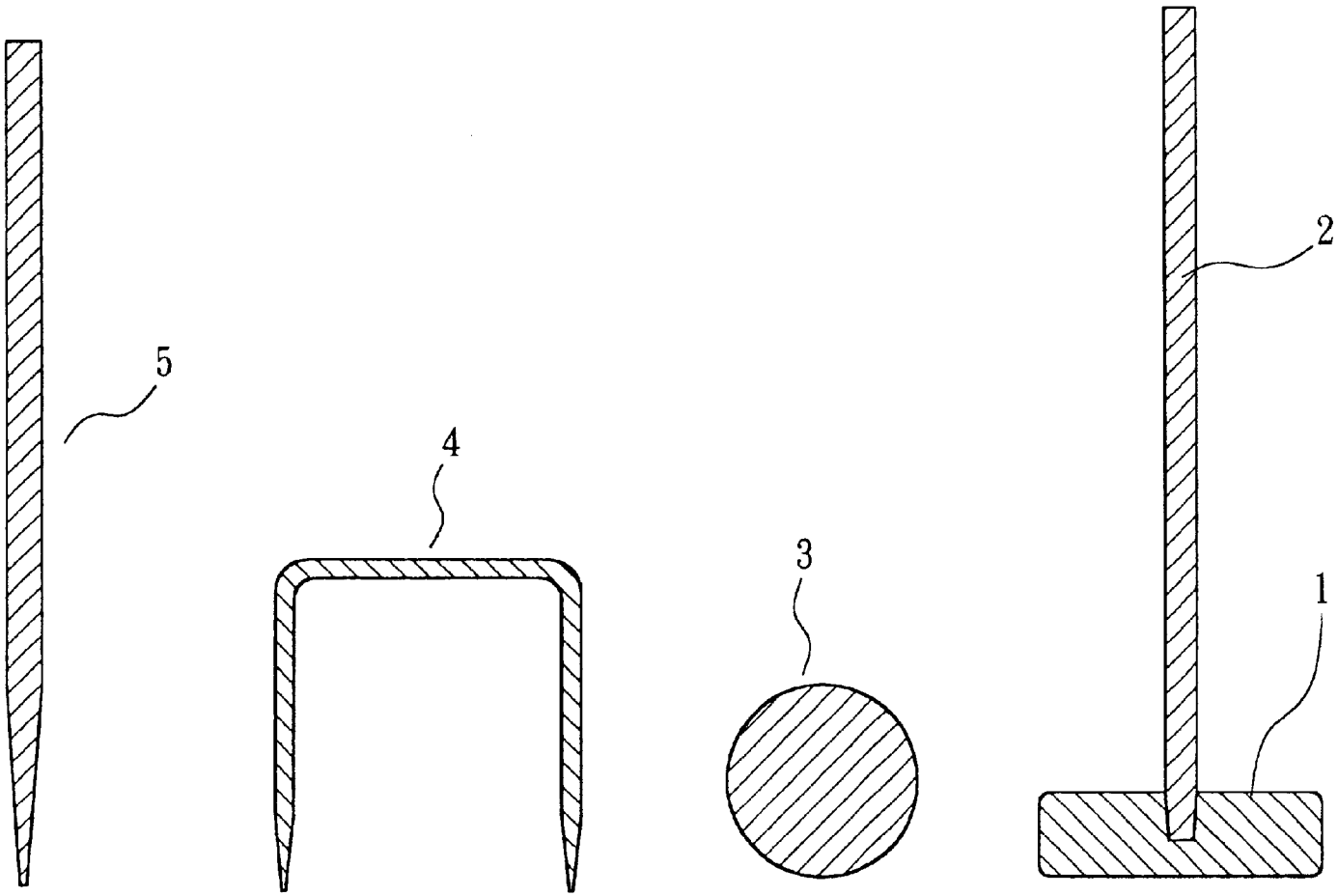
PRIOR ART Fig. 1
FIG. 1 is a sectional view showing a mallet, a ball, a hoop, and a stake for the game of croquet according to the prior art design.
Figure 2A:
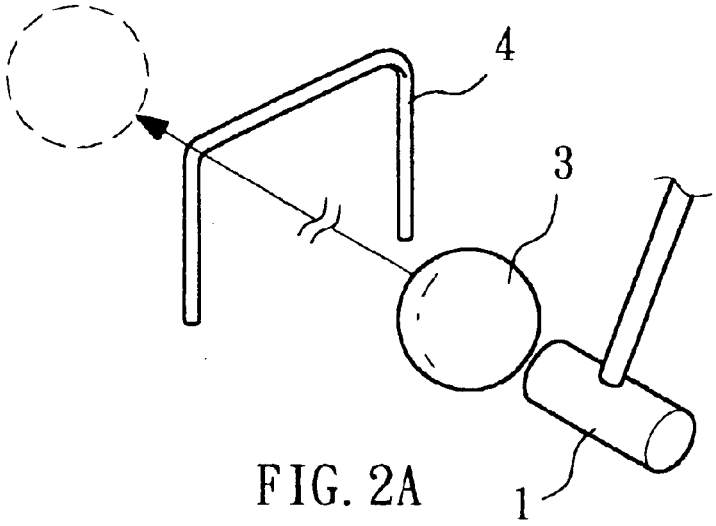
FIG. 2A is a schematic drawing showing one playing mode of the game of croquet.
Figure 2B:
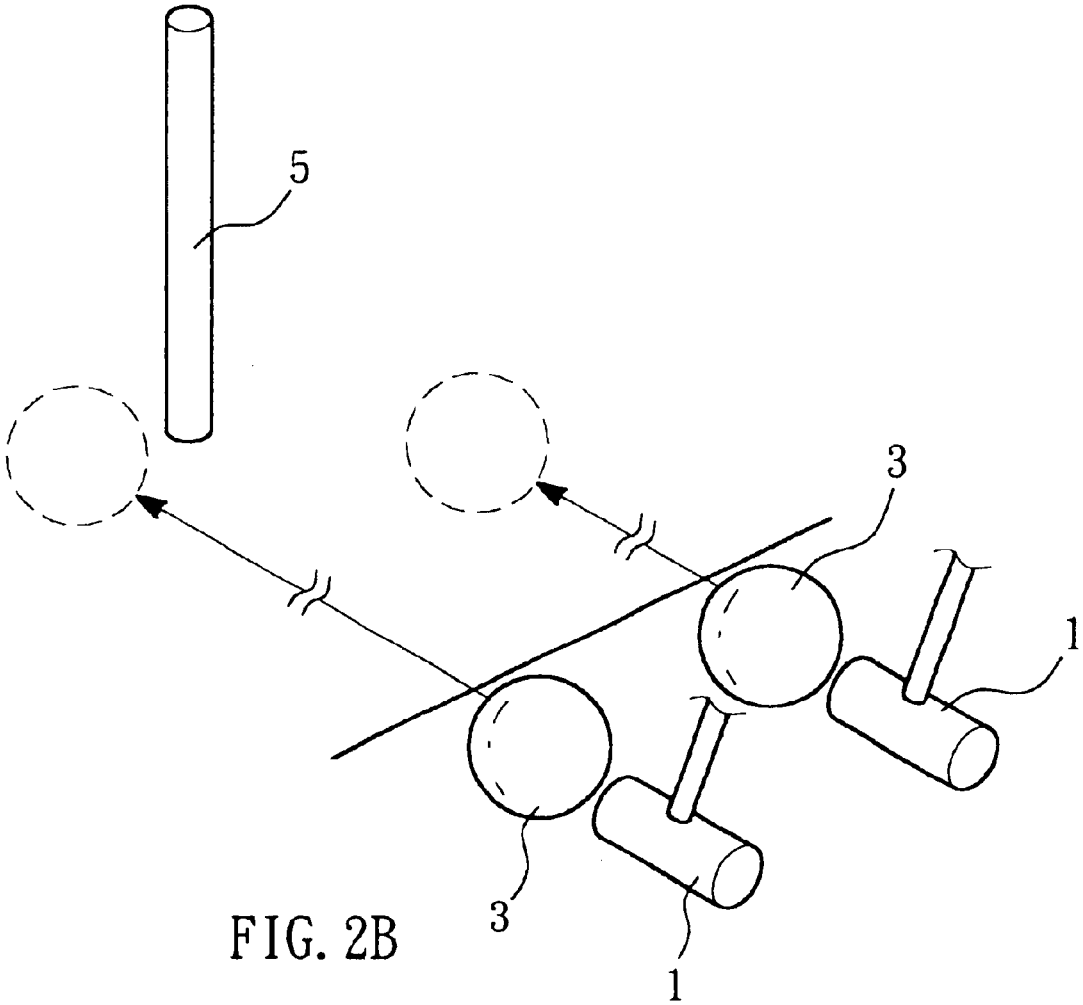
FIG. 2B is a schematic drawing showing a second playing mode of the game of croquet.
Figure 3A:
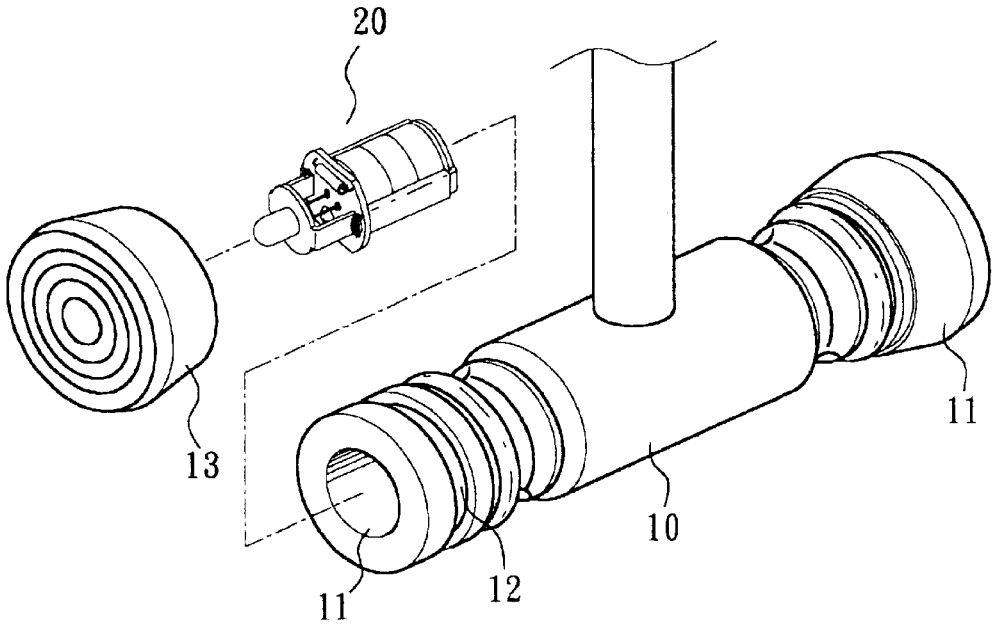
FIG. 3A is an exploded view of a part of a mallet for the game of croquet according to the present invention.
Figure 3B:
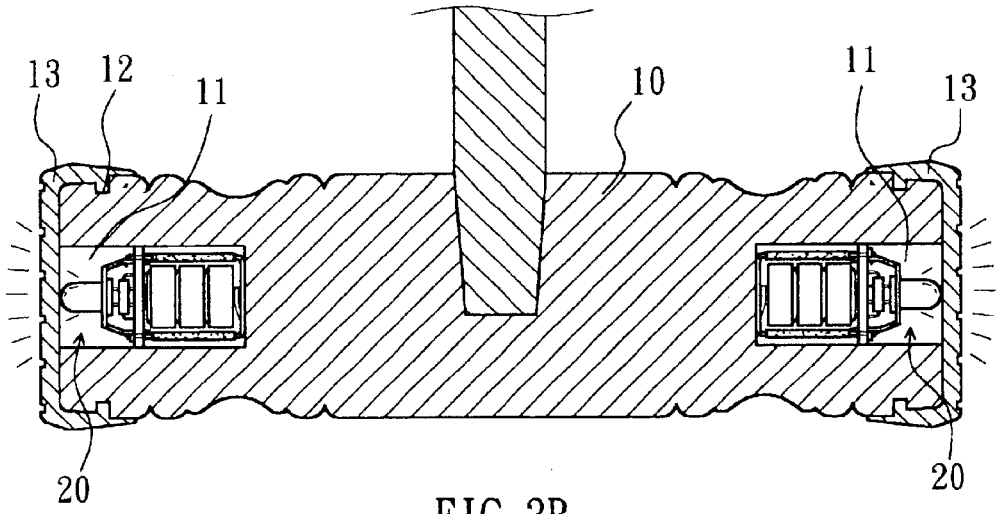
FIG. 3B is a sectional assembly view of the mallet shown in FIG. 3A.

Referring to FIGS. 3A and 3B, the mallet 10 has two recessed receiving holes 11 respectively axially extended in the two ends of the head thereof, which receive a respective light emitting module 20, two coupling grooves 12 respectively extended around the periphery of the head near the ends, and two plastic face members 13 respectively capped on the ends of the head and fastened to the coupling grooves 12 to seal the respective light emitting modules 20 in the recessed receiving holes 11. The plastic face members 13 admit light.

Figure 4A:
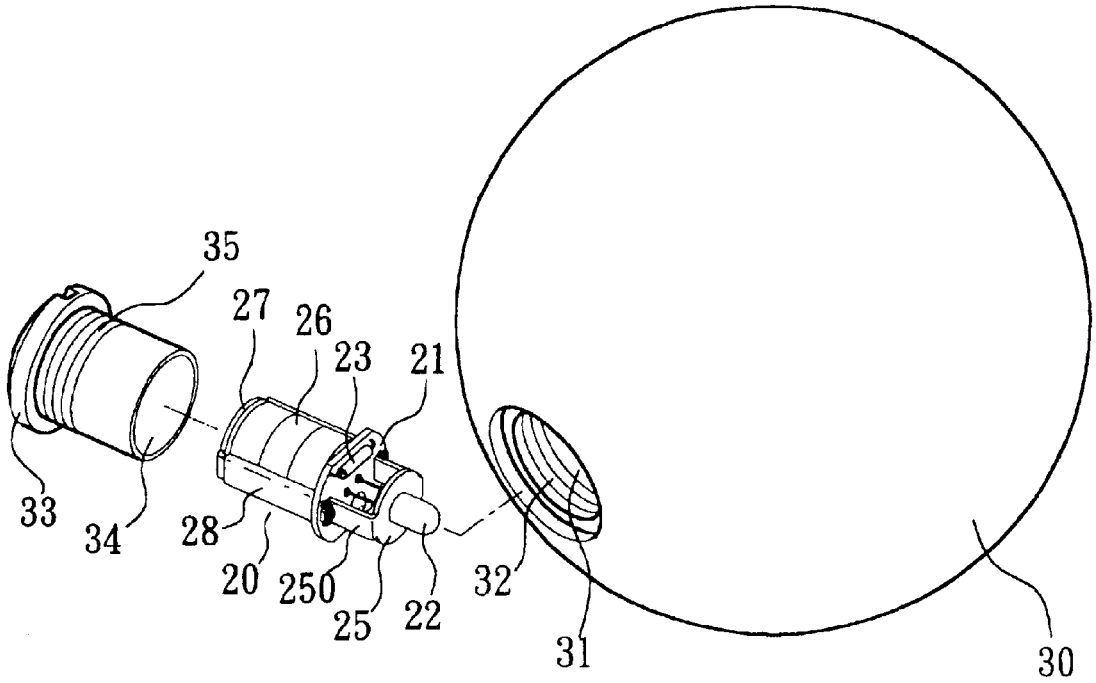
FIG. 4A is an exploded view of a ball for the game of croquet according to the present invention.
Figure 4B:
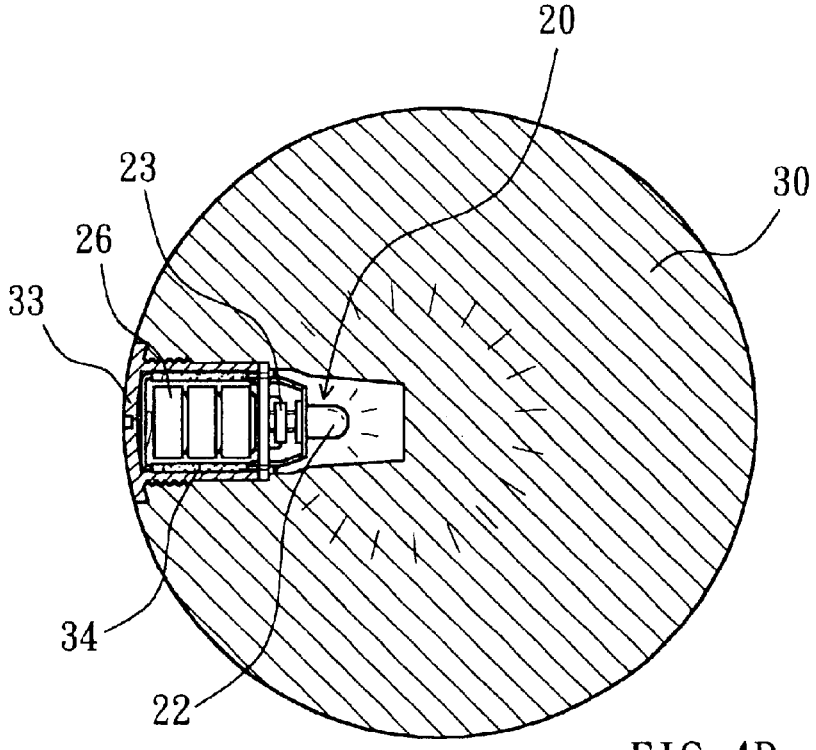
FIG. 4B is a sectional assembly view of the ball shown in FIG. 4A.

Referring to FIGS. 4A and 4B, the ball 30 is a solid ball molded from light penetrable plastics, having a radially extended receiving hole 31, which receives one tight emitting module 20, an inner thread 32 formed in the radially extended receiving hole 31, and a screw cap 33, which closes the radially extended receiving hole 31. The screw cap 33 has a hollow cylindrical cap body 34 inserted into the radially extended receiving hole 31 to hold the light emitting module 20 inside the ball 30, and an outer thread 35 extended around the periphery of the cap body 34 and threaded into the inner thread 32. When installed, the screw cap 33 is maintained in flush with the periphery of the ball 30.

Figure 7A:
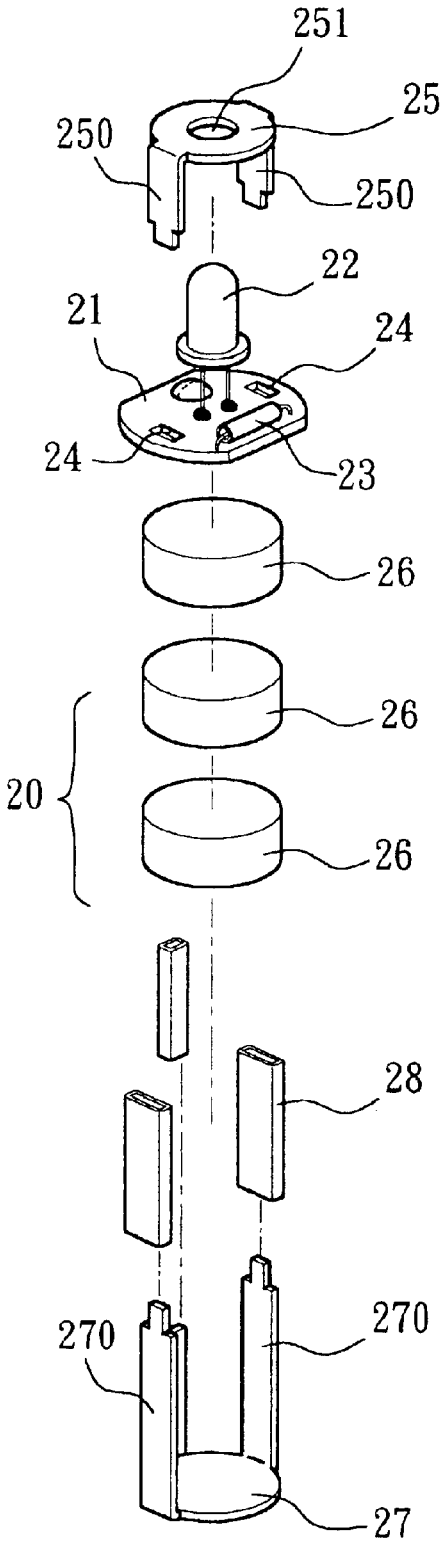
FIG. 7A is an exploded view of a light emitting module for the game of croquet according to the present invention.
Figure 7B:
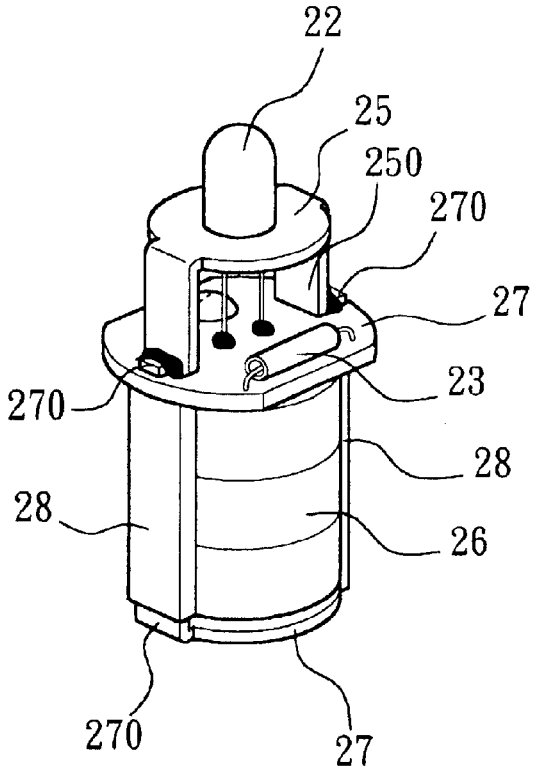
FIG. 7B is an elevational assembly view of the light emitting module shown in FIG. 7A.

Referring to FIGS. 7A and 7B, the light emitting module comprises a circuit board 21, the circuit board 21 having two plug holes 24, a light emitting element, for example, a LED (light emitting diode) 22 installed in the circuit board 21, a vibration switch 23 installed in the circuit board 21 and adapted to switch on the LED 22 upon a vibration, a metal LED holder frame 25 fastened to the top side of the circuit board 21 to hold the LED 22 in position, the metal LED holder frame 25 having two mounting legs 250 respectively fastened to the plug holes 24 of the circuit board 21 and a center through hole 251, which accommodates the LED 22, a metal battery holder frame 27 fastened to the bottom side of the circuit board 21, the metal battery holder frame 27 having two mounting legs 270 respectively sleeved with a respective insulating sleeve 28 and respectively fastened to the plug holes 24 of the circuit board 21 and respectively soldered to the mounting legs 250 of the metal LED holder frame 25, and a set of battery cells 26 carried in the metal battery holder frame 27. The metal LED holder frame 25, the LED 22, the circuit board 21, the set of battery cells 26 and the metal battery holder frame 27 form an electric loop, which is closed/opened by means of the control of the vibration switch 23. Further, the metal LED holder frame 25 and the metal battery holder frame 27 reinforce the structural strength of the circuit board 21 to bear impact.

Figure 5:
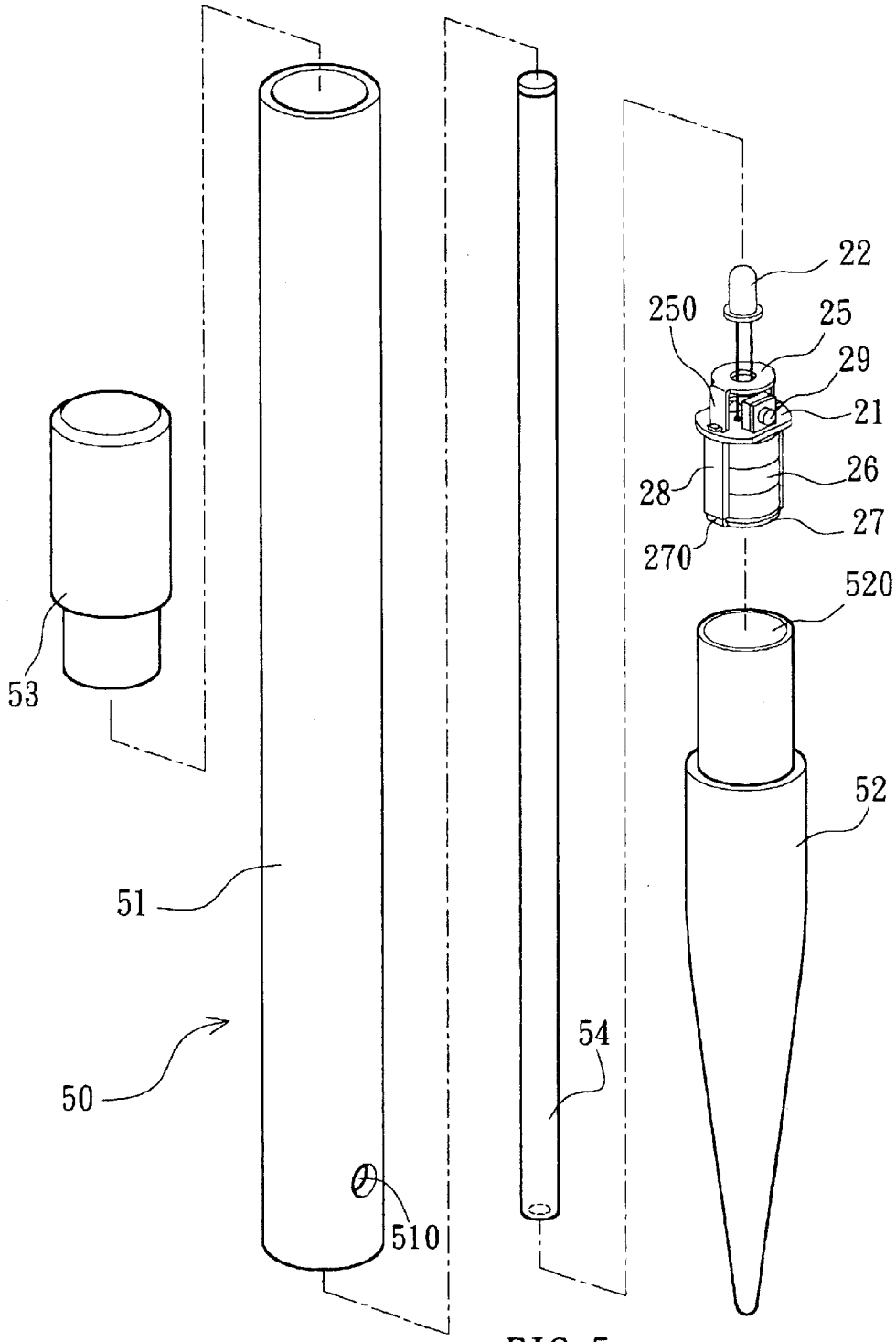
FIG. 5 is an exploded view of a stake for the game of croquet according to the present invention.
Figure 6:
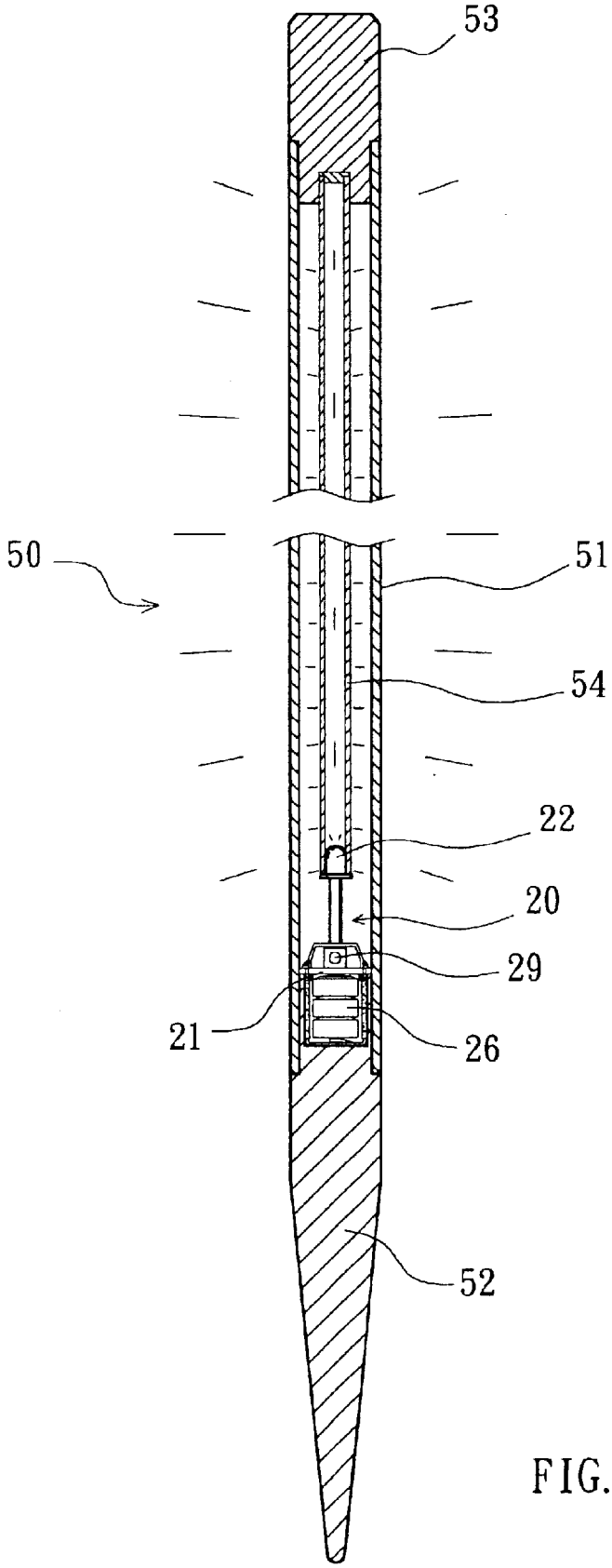
FIG. 6 is a sectional assembly view of the stake shown in FIG. 5.

Referring to FIGS. 5 and 6, the stake 50 is comprised of a tubular shaft 51, an anchoring point 52, a cap 53, and an elongated light guide 54. The tubular shaft 51 admits light, having a switch hole 510. The anchoring point 52 has a hollow neck 520, which is fastened to one end, namely, the bottom end of the tubular shaft 51, and holds one light emitting module 20. The light emitting module 20 installed in the stake 50 uses a manual on/off switch 29 to substitute for the aforesaid vibration switch 23. The elongated light guide 54 is axially suspended in the tubular shaft 51 and fastened to the LED 22 of the light emitting module 20, which is installed in the hollow neck 520 of the anchoring point 52. The cap 53 is fastened to the other end, namely, the top end of the tubular shank 51. When assembled, the manual on/off switch 29 is suspended the switch hole 510 of the tubular shaft 51 for switching by the user.

As indicated above, the light emitting modules 20 are independent devices respectively installed in the mallet 10, the ball 30, and the stake 50. When battery low, the light emitting module 20 can be taken out of the mallet 10, the ball 30, or the stake 50 for a replacement after removal of the corresponding plastic face member 13 from the mallet 10 or the screw cap 33 from the ball 30, or after disconnection of the tubular shaft 51 from the anchoring point 52.

When moving the mallet 10 to hit the ball 30, the vibration switches 23 of the light emitting modules 20 in the mallet 10 and the ball 30 are vibrated to intermittently switch on/off the respective LEDs 22, thereby causing the respective LEDs 22 to flash.

When using the stake 50, insert a rod member into the switch hole 510 of the tubular shaft 51 to switch on the manual on/off switch 29 of the respective light emitting module 20 before fastening the stake 50 to the ground, causing the LED 22 to emit light. When the LED 22 was turned on, the elongated light guide 54 guides light to pass through the whole area of the periphery of the tubular shaft 51.

As indicated above, the light emitting modules 20 have the following advantages:

(1) The metal LED holder frame 25 holds the respective LED 22 on the circuit board 21 firmly in position against impact.

(2) The metal battery holder frame 27 holds the respective set of battery cells 26 on the circuit board 21 firmly in place against impact.

(3) The metal LED holder frame 25 and the metal battery holder frame 27 are soldered together and fixedly fastened to the circuit board 21 to reinforce the structural strength of the circuit board 21.

(4) The mounting legs 250 and 270 of the metal LED holder frame 25 and metal battery holder frame 27 are resilient, which are press-fitted into the plug holes 24 of the circuit board 21 to firmly secure the metal LED holder frame 25 and the metal battery holder frame 27 to the circuit board 21.

(5) The mounting legs 270 of the metal battery holder frame 27 are sleeved with insulating sleeves 28, which prevent a short circuit and, hold the set of battery cells 26 firmly in the metal battery holder frame 27.

(6) The light emitting modules 20 are independent modules that allow the user to replace the battery conveniently.

A prototype of equipment for croquet has been constructed with the features of FIGS. 3~7. The equipment for croquet functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. Croquet equipment comprising a mallet, a ball, a hoop, and a stake, wherein:

said mallet comprises two recessed receiving holes respectively axially extended in two ends of a head thereof, two light emitting modules respectively detachably mounted in said recessed receiving holes and adapted to emit light through said mallet, and two plastic face members respectively capped on the two ends of said head to seal the respective light emitting modules in said recessed receiving holes, said plastic face members admitting light;

said ball is molded from light penetrable plastics, comprising an internally threaded and radially extended receiving hole, a light emitting module detachably mounted in said internally threaded and radially extended receiving hole and adapted to emit light through said ball, and a screw cap threaded into said internally threaded and radially extended receiving hole and maintained in flush with the periphery of said ball to hold the light emitting module in said ball;

said stake is comprised of a light penetrable tubular shaft, said tubular shaft having a bottom end and a top end, an anchoring point fastened to the bottom end of said tubular shaft, said anchoring point having a hollow neck fastened to the bottom end of said tubular shaft, a cap fastened to the top end of said tubular shaft, a light emitting module mounted in the hollow neck of said anchoring point, and an elongated light guide connected to the light emitting module in said hollow neck of said anchoring point and axially suspended in said tubular shaft.

2. The croquet equipment as claimed in claim 1, wherein the light emitting modules of said mallet, said ball and said stake each comprise a circuit board, said circuit board having two plug holes, a light emitting element, installed in said circuit board, switch means installed in said circuit board and adapted to switch on/off said light emitting element, a metal LED holder frame fastened to a top side of said circuit board to hold said light emitting element in position, said metal LED holder frame having two mounting legs respectively fastened to the plug holes of said circuit board and a center through hole accommodating said light emitting element, a metal battery holder frame fastened to a bottom side of said circuit board, said metal battery holder frame having two mounting legs respectively sleeved with a respective insulating sleeve and respectively fastened to the plug holes of said circuit board and respectively soldered to the mounting legs of said metal LED holder frame, and a set of battery cells carried in said metal battery holder frame and electrically connected to said light emitting element via said switch means.

3. The croquet equipment as claimed in claim 2, wherein the switch means of each of the light emitting modules in said mallet and said ball is a vibration switch, and the switch means of said stake is a manual on/off switch.

* * * * *